US006592407B2

(12) United States Patent
Korunsky et al.

(10) Patent No.: US 6,592,407 B2
(45) Date of Patent: Jul. 15, 2003

(54) HIGH-SPEED CARD EDGE CONNECTOR

(75) Inventors: Iosif R. Korunsky, Harrisburg, PA (US); Wei-Chen Lee, Harrisburg, PA (US); Joanne E. Shipe, Harrisburg, PA (US); Tod M. Harlan, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/161,958

(22) Filed: Jun. 3, 2002

(65) Prior Publication Data

US 2002/0173177 A1 Nov. 21, 2002

Related U.S. Application Data

(63) Continuation-in-part of application No. 09/858,841, filed on May 15, 2001, now Pat. No. 6,447,304, and a continuation-in-part of application No. 10/011,360, filed on Nov. 5, 2001, now Pat. No. 6,439,930.

(51) Int. Cl.[7] ..... H01R 24/00
(52) U.S. Cl. ..... 439/637; 439/108
(58) Field of Search ..... 439/637, 60, 108, 439/62, 101

(56) References Cited

U.S. PATENT DOCUMENTS 3,530,422 A * 9/1970 Goodman ..... 439/637
3,587,029 A * 6/1971 Knowles ..... 439/108
5,024,609 A * 6/1991 Piorunneck ..... 439/637
5,035,631 A * 7/1991 Piorunneck et al. ..... 439/108
5,052,936 A * 10/1991 Biechler et al. ..... 439/60
6,152,742 A * 11/2000 Cohen et al. ..... 439/60
6,315,615 B1 * 11/2001 Raistrick ..... 439/637
6,347,950 B1 * 2/2002 Yokoyama et al. ..... 439/248
6,394,823 B1 * 5/2002 Dunham et al. ..... 439/108

* cited by examiner

*Primary Examiner*—Lynn D. Feild
*Assistant Examiner*—Hae Moon Hyeon
(74) *Attorney, Agent, or Firm*—Wei Te Chung

(57) ABSTRACT

An electrical connector (1) includes an insulative member (10) defining two rows of slanted cavities (30) along a longitudinal direction thereof, two rows of conductive contacts (12) obliquely received in corresponding slanted cavities and two grounding plates (32) with over-molded insulative inserts (34) attached to the insulative member. Each grounding plate electrically contacts some selected conductive contacts via ribs (39) thereof, which are therefore grounding contacts, and is isolated from the other conductive contacts, which are therefore signal contacts. Each grounding plate has a number of enlarged tails (38) for elastically engaging with corresponding plated holes (54) in a mother board (46) that the electrical connector is adapted to be mounted on. The conductive contacts slide along the mother board upon insertion of a daughter board (52) to the electrical connector.

17 Claims, 7 Drawing Sheets

HIGH-SPEED CARD EDGE CONNECTOR

This patent application is a continuation-in-part (CIP) of patent application Ser. No. 09/858,841, filed on May 15, 2001now U.S. Pat. No. 6,947,304, and a CIP of patent application Ser. No. 10/011,360, filed on Nov. 5, 2001 now U.S. Pat. No. 6,439,930.

BACKGROUND OF THE INVENTION

1. Field of the Invention

The present invention relates to a card edge connector, and particularly to a high-speed card edge connector which has improved grounding feature to enhance the signal transmitting quality of the connector, and contacts which can perform wiping action on conductive pads of a mother board which the connector mounts on.

2. Description of the Related Art

The needs of today's electronic industry require higher speed electronic equipment such as computers and the like. Since many of the electrical interconnections within this type of equipment use circuit boards, it is desirable to provide high-speed card edge connectors having a controlled impedance that will essentially match the impedance of the circuit boards. A high-speed connector is one that can pass fast rise time signals without distorting or degrading that rise time. It is desirable, therefore, to control the impedance of the connector to reduce signal reflection caused by changes in impedance in the pathways conducting the digital pulse. Impedance control includes controlled spacing of ground and signal traces and interconnections. With the closer spacing of the conductors, it is also necessary to prevent cross talk between adjacent conductors.

U.S. Pat. Nos. 5,024,609, issued to Burndy Corporation on Jun. 18, 1991 and 5,820,392, issued to Hon Hai Precision Ind. Co., Ltd., on Oct. 13, 1998 each disclose a high-speed card edge connector having a housing and first and second types of conductive contacts. The housing defines a plurality of contact receiving chambers each receiving a first and a second types of conductive contacts at respective upper and lower locations, wherein the first and the second types of the conductive contacts are isolated from each other. Due to the locations of the first and the second types of conductive contacts, the connector has an advantage that pitches between two adjacent conductive contacts of a same row are double of that of a connector having the same number of conductive contacts which are arranged in a single row. So the connector disclosed above has a better electronic performance than other connectors. However, the connector disclosed above is relatively higher than the other connectors, which is undesirable for certain applications.

U.S. Pat. Nos. 6,095,821 and 6,015,299, both issued to Molex Incorporated respectively on Aug. 1, 2000 and Jan. 18, 2000, 5,921,784 and 5,919,049, both issued to Framatome Connectors respectively on Jul. 13, 1999 and Jul. 6, 1999, each disclose a high-speed card edge connector. The connectors disclosed in the above patents each have an insulative housing, a plurality of conductive contacts assembled to the insulative housing, wherein some of the conductive contacts function as grounding members to reduce cross-talk between adjacent signal contacts, thereby improving electronic performances of the connector. The conductive contacts for signal transmitting purpose have a different configuration from the conductive contacts for grounding purpose and contact receiving cavities of the insulative housing have two different configurations to accommodate the conductive contacts of different configurations, respectively. These connectors are complex both in manufacturing and assembly. Further, these connectors are unable to meet the requirement of changing the location of the grounding contacts or the number of the grounding contacts without changing the insulative housing. Also, these connectors do not have shielding means for protecting the signals transmitting therethrough from external magnetic field fluctuations.

U.S. Pat. No. 5,035,631, issued to Burndy Corporation on Jul. 30, 1991, discloses a ground shielded card edge connector having an insulative housing, a plurality of conductive contacts fitted to the insulative housing and a pair of ground shields attaching to opposite side faces of the insulative housing. The ground shields are electrically connected to grounding means on an inserted daughter card via conductive members attached to the grounding means of the daughter card. The conductive members are exposed out of the connector which does not provide ease of assembly of the connector and the daughter card. Hence, an improved electrical connector is required to overcome the disadvantages of the prior art.

SUMMARY OF THE INVENTION

A first objective of the present invention is to provide an electrical connector having grounding plates for protecting signals transmitting through conductive contacts thereof; and A second objective of the present invention is to provide an electrical connector having grounding plates that are electrically connected with some desired conductive contacts to improve electrical performance of the electrical connector.

To fulfill the above objectives, an electrical connector includes an insulative member defining two rows of slanted cavities along a longitudinal direction thereof, two rows of conductive contacts obliquely received in corresponding slanted cavities and two grounding plates, with over-molded insulative inserts, attached to the insulative member and being near the rows of conductive contacts to shield the conductive contacts. Each grounding plate electrically contacts some selected conductive contacts, which are therefore grounding contacts, and is isolated from the other conductive contacts, which are therefore signal contacts. Each grounding plate has a number of enlarged tails for elastically engaging with corresponding plated holes in a mother board which the electrical connector is adapted to be mounted on. A daughter board is able to be inserted to the electrical connector in a direction perpendicular to the mother board. Upon the insertion of the daughter board to the electrical connector, the conductive contacts are forced by the daughter board to slide along the daughter and mother boards in perpendicular directions.

Other objectives, advantages and novel features of the invention will become more apparent from the following detailed description of the present embodiment when taken in conjunction with the accompanying drawings.

DESCRIPTION OF THE PREFERRED EMBODIMENT

Figure 1:
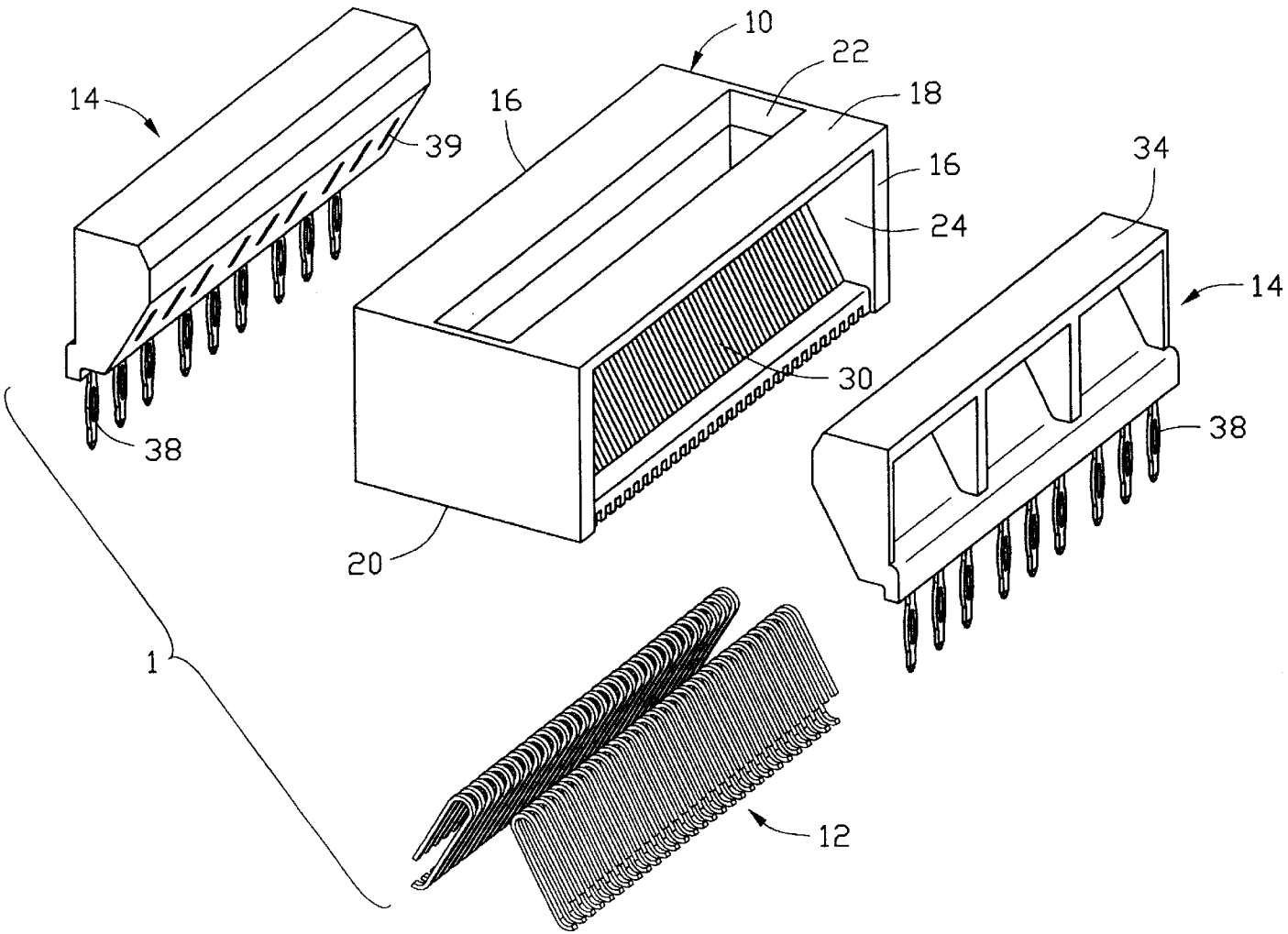
FIG. 1 is an exploded perspective view of an electrical connector in accordance with the present invention.
Figure 2:
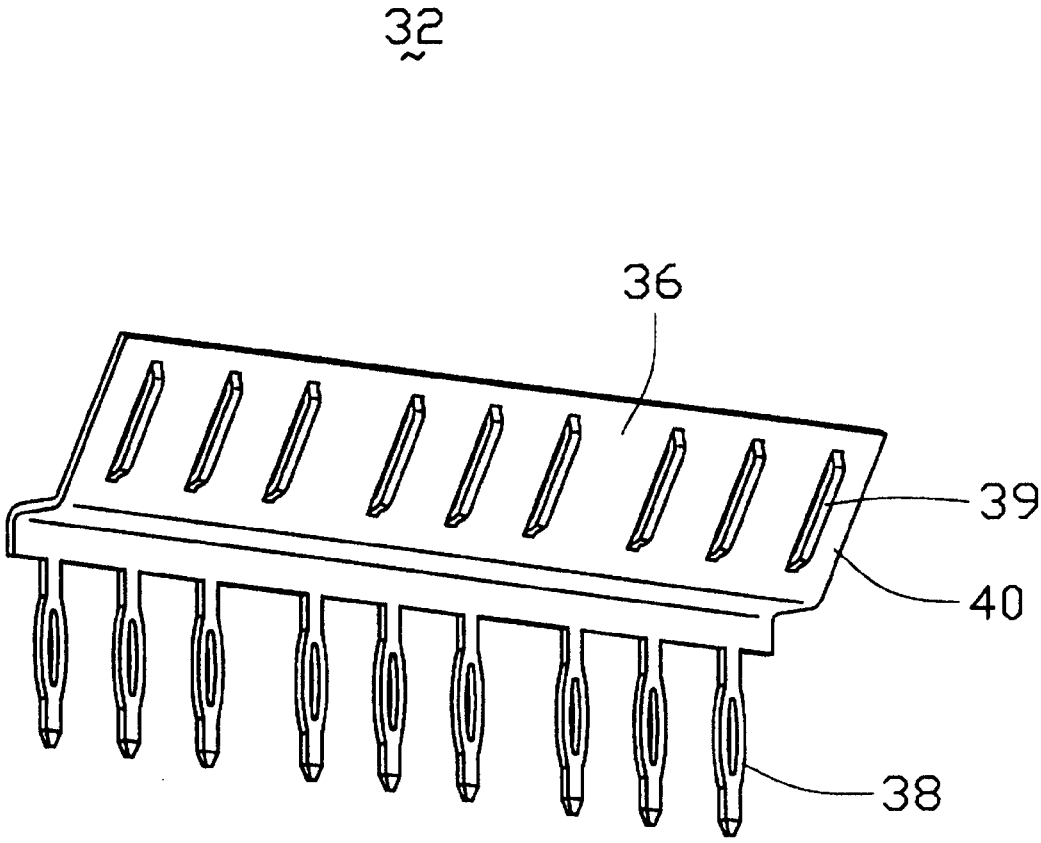
FIG. 2 is a perspective view of a grounding plate of the electrical connector.
Figure 3:
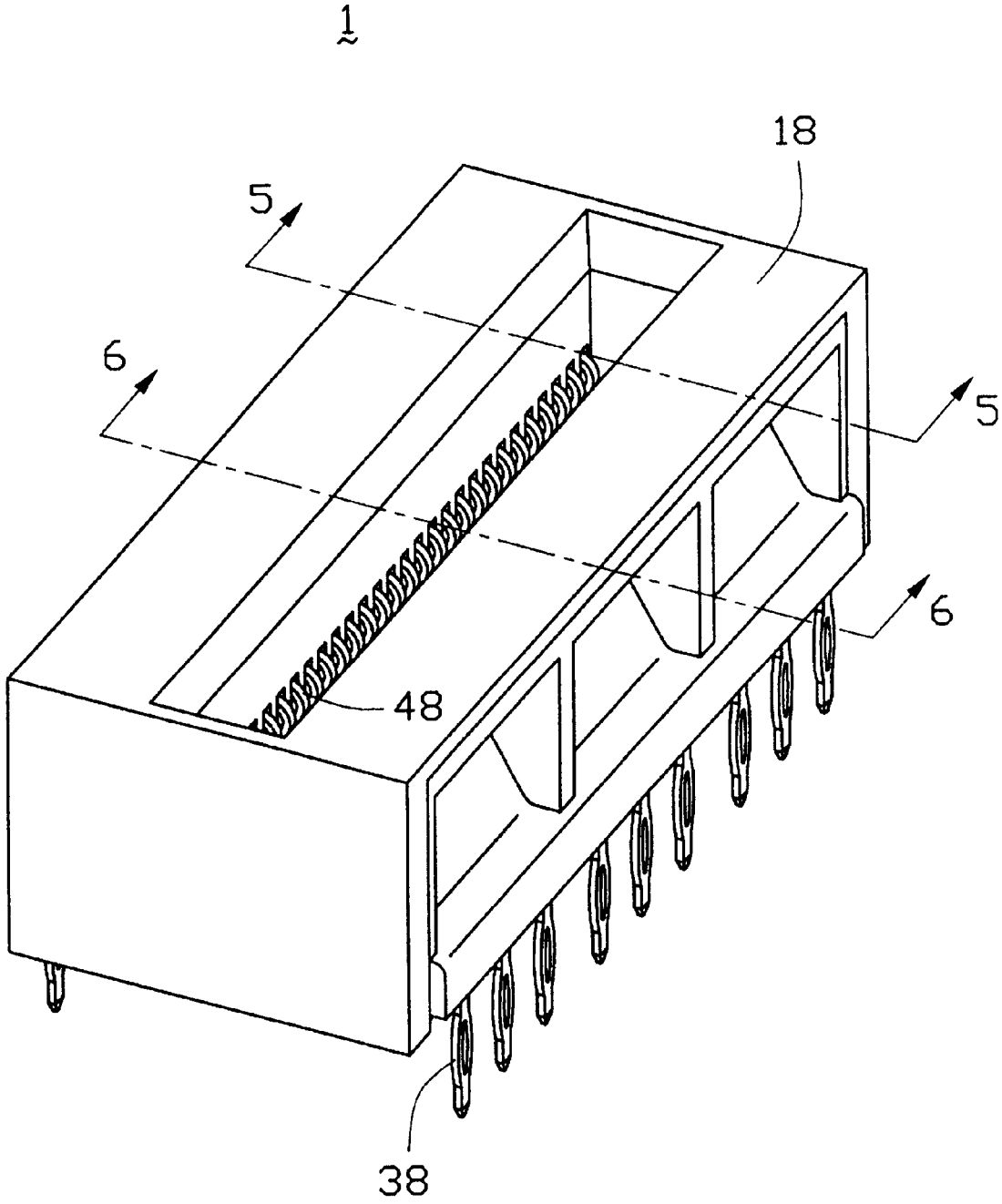
FIG. 3 is an assembled perspective view of FIG. 1 from a top aspect.
Figure 4:
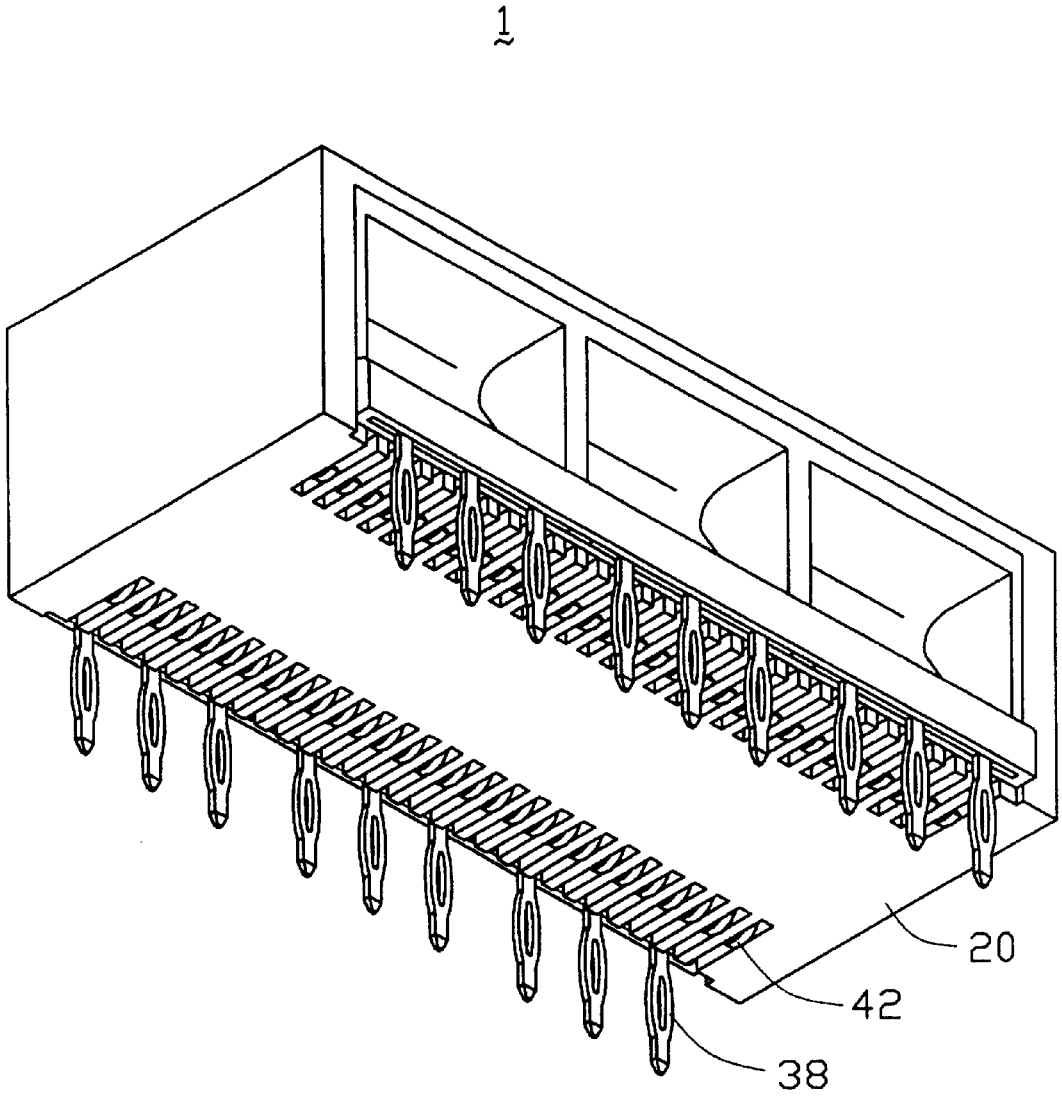
FIG. 4 is a view similar to FIG. 3, viewed from a bottom aspect.
Figure 5:
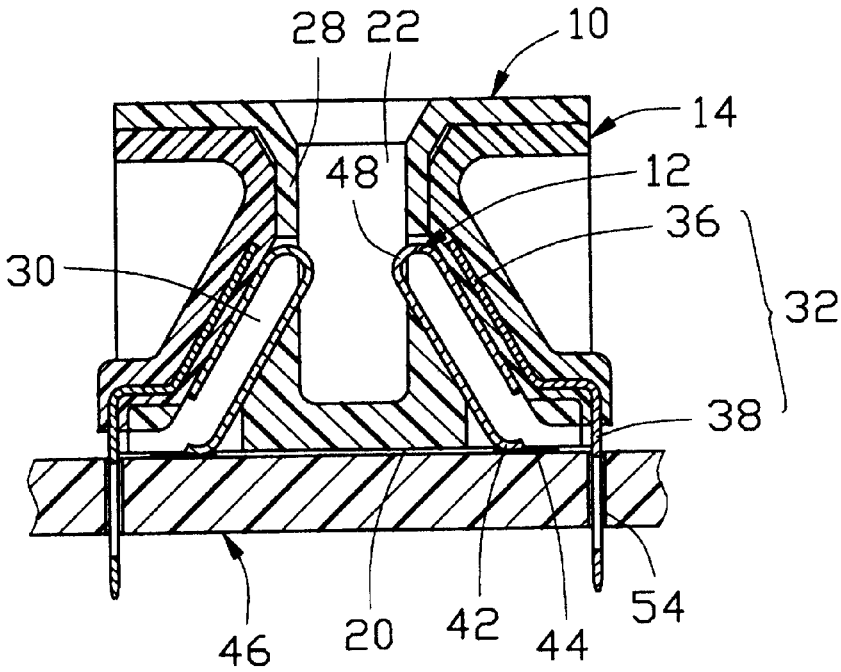
FIG. 5 is a cross-sectional view taken along line 4—4 of FIG. 3.
Figure 6:
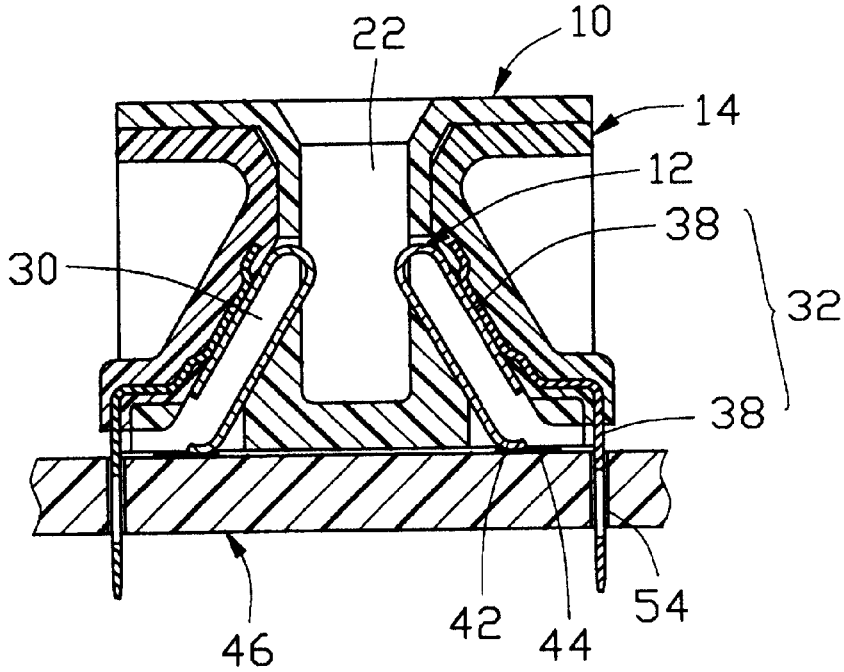
FIG. 6 is a cross-sectional view taken along line 5—5 of FIG. 3.
Figure 7:
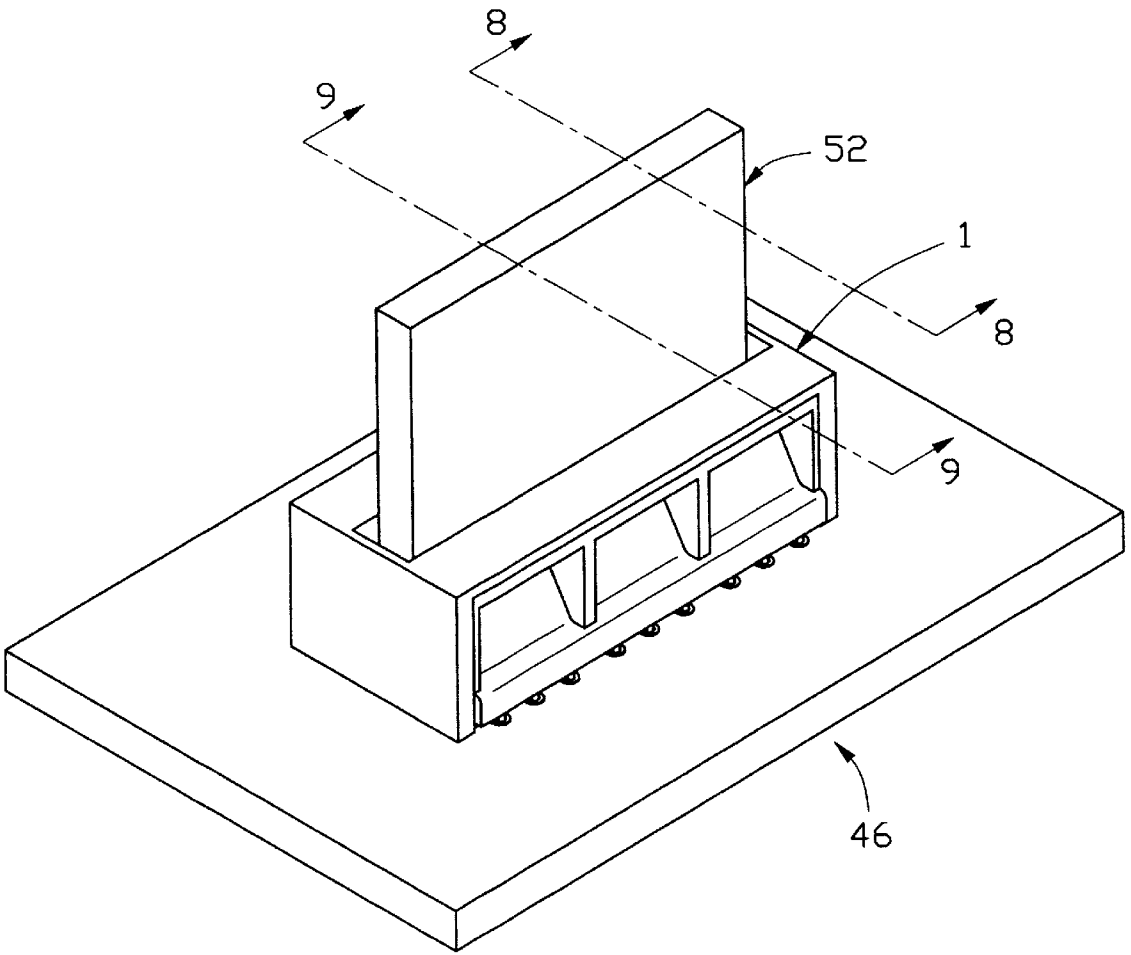
FIG. 7 is a top perspective view of the connector shown in FIG. 3, connecting a mother board with an inserted daughter board.
Figure 8:
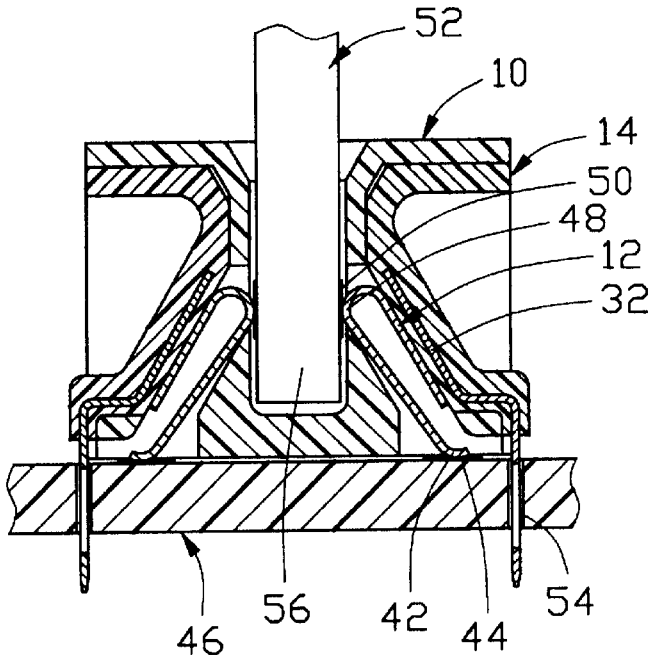
FIG. 8 is a cross-sectional view taken along line 8—8 of FIG. 7.
Figure 9:
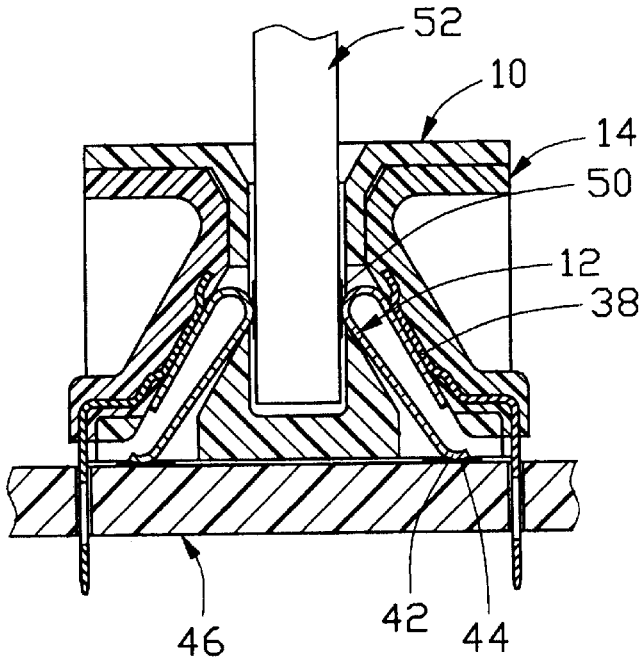
FIG. 9 is a cross-sectional view taken along line 9—9 of FIG. 7.

Referring to FIGS. 1–4, an electrical connector 1 in accordance with the present invention comprises an insulative member 10, a plurality of conductive contacts 12 retained to the insulative member 10 and a pair of terminal modules 14 retained in two chambers 24 defined in opposite side faces 16 of the insulative member 10. The insulative member 10 has a top face 18, an opposite bottom face 20, and the two opposite side faces 16 between the top and bottom faces 18, 20. The insulative member 10 defines a slot 22 in the top face 18 extending toward but not reaching the bottom face 20 for receiving an end of a daughter board 52 (FIGS. 7–9). The chambers 24 are communicated with the slot 22 via a plurality of slanted cavities 30 defined in a septum 28 between the chamber 24 and the slots 22 (FIGS. 5 and 6). The slanted cavities 30 obliquely receive corresponding conductive contacts 12 therein. Each terminal module 14 includes a grounding plate 32 stamped and formed from a metal sheet (FIG. 2) and an insulative insert 34 insert-molded to the grounding plate 32. The grounding plate 32 has a body portion 36 and a row of enlarged tails 38 being oblique to the body portion 36. The body portion 36 provides a number of ribs 39 projecting beyond a basic surface 40 thereof for electrically contacting some desired conductive contacts 12. The enlarged tails 38 are configured as press-fit tails to be press-fit into plated through holes 54 (FIG. 5) of a mother board 46 so that the grounding plates 32 can be electrically connected to the mother board 46 without soldering, to thereby eliminate the possible problems of solder joints.

Referring to FIGS. 5 and 6, after the assembly of the electrical connector 1, the grounding plates 32 are disposed adjacent to the conductive contacts 12 for shielding these conductive contacts 12 and electrically contact some desired conductive contacts via the ribs 39 thereof which are therefore grounding contacts, but are isolated from the other conductive contacts which are therefore signal contacts. Each conductive contact 12 includes a first contact portion 42 downwardly extending beyond the bottom face 20 of the insulative member 10 to electrically contact a corresponding first conductive pad 44 on the mother board 46 and a second contact portion 48 extending into the slot 22 of the insulative member 10 via the cavities 30 in the septum 28 to electrically contact a corresponding second conductive pad 50 on the daughter board 52 (FIGS. 8 and 9). The enlarged tails 38 elastically engage with peripheral walls of corresponding plated through holes 54.

Referring to FIGS. 7–9 in conjunction with FIGS. 5 and 6, the conductive contacts 12 are pushed downwardly by the daughter board 52 upon insertion of the daughter board 52 into the slot 22. The second contact portions 48 slide along a tip portion 56 of the daughter board 52 and then on corresponding second conductive pads 50 until the tip portion 56 arrives at a desired position. At the same time, the first contact portions 42 slide laterally or outwardly on corresponding first conductive pads 44 of the mother board 46 and the some desired electrical contacts 12 wipe the ribs 39 of the grounding plates 32 as is shown in FIGS. 8 and 9. Thus, contamination and metal oxide film on the first and second conductive pads 44, 50 and the first and second contacting portions 42, 48 and the ribs 39 are wiped to improve the signal transmitting performance of the connector 1. Furthermore, the number of the ribs 39 and the locations of the ribs 39 can be changed by adjusting the dies during the stamping and forming of the grounding plates 32 so that the number of the contacts 12 in connection with the grounding plates 32 can be changed accordingly, thereby adjusting the impedance of the connector to meet a prescribed requirement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative member having a top face, a bottom face and two side faces between the top and bottom faces, the top face defining a slot toward the bottom face adapted for receiving an end section of a daughter board therein, the side faces each defining a chamber therein;

two grounding modules respectively received in the chambers of the insulative member, each grounding module having a grounding plate insert-molded to an insulative body thereof; and electrical contacts disposed in the insulative member each having a first contact portion protruding into the slot of the insulative member adapted for electrically connecting with conductive elements of the daughter board and a second contact portion protruding downwardly beyond the bottom face of the insulative member adapted for electrically connecting with conductive elements of a mother board, wherein at least two of the electrical contacts are electrically connected with the grounding plates of the grounding modules.

2. The electrical connector as claimed in claim 1, wherein each of the grounding plates has press-fit tails adapted for being press-fitted into a mother board.

3. The electrical connector as claimed in claim 1, wherein the grounding plates each have projecting ribs exposed out of the insulative bodies of the grounding modules, the projecting ribs being connected with the at least two of the electrical contacts.

4. The electrical connector as claimed in claim 3, wherein the at least two of the electrical contacts wipe the projecting ribs of the grounding plates that are electrically connected with the at least two of the electrical contacts upon the insertion of the end section of the daughter board into the slot of the insulative member.

5. The electrical connector as claimed in claim 1, wherein the insulative member defines a plurality of slanted cavities from the bottom face thereof to the slot, the electrical contacts being unitarily moveable in the slanted cavities upon the insertion of the end of the daughter board into the slot.

6. An electrical system comprising:

a mother board having a plurality of first conductive pads;

an electrical connector positioned on the mother board and having an insulative member, a plurality of conductive contacts and a module retained in the insulative member, the conductive contacts each having a first contact portion electrically contacting corresponding first conductive pads on the mother board, the insulative member defining a chamber in a side face thereof wherein the module is retained; and a daughter board having an end section to be inserted into a slot defined in the electrical connector in a direction generally perpendicular to the mother board, the end section having a plurality of second conductive pads electrically contacting second contact portions of corresponding conductive contacts thereby establishing electrical connections between the mother board and the daughter board;

wherein during the insertion of the end section of the daughter board into the slot of the electrical connector, the first and the second contact portions of the electrical contacts wiping respectively the first and second conductive pads along directions perpendicular to each other.

7. The electrical system as claimed in claim 6, wherein the module includes at least one grounding plate electrically contacting at least one of the conductive contacts but being isolated from the other of the conductive contacts.

8. The electrical system as claimed in claim 7, wherein the at least one grounding plate has at least one rib extending beyond a basic surface thereof to electrically contact the at least one conductive contact.

9. The electrical system as claimed in claim 7, wherein the at least one grounding plate has at least one press-fit tail engageably inserted into at least one plated hole in the mother board.

10. An electrical connector comprising:

an insulative member defining a chamber in a side surface thereof;

a row of electrical contacts assembled to the insulative member; and a grounding plate laterally received in the chamber of the insulative housing adapted for electrically connecting to a grounding element of a mother board, the grounding plate being disposed near the row of electrical contacts and extending substantially to be parallel with the row of electrical contacts for shielding the row of electrical contacts, the grounding plate electrically contacting at least one of the row of electrical contacts for grounding the at least one electrical contact.

11. The electrical connector as claimed in claim 10, wherein the grounding plate has at least one rib projecting toward and electrically contacting the at least one electrical contact.

12. The electrical connector as claimed in claim 11, wherein the at least one electrical contact wipes the at least one rib of the grounding plate when a daughter board is inserted to mate with the electrical connector.

13. The electrical connector as claimed in claim 11, wherein an insulative element is insert-molded to the grounding plate to form a grounding module with the at least one rib projecting out of the insulative element.

14. The electrical connector as claimed in claim 10, wherein the grounding plate has press-fit tails adapted for being press-fitted into plated through holes of the mother board.

15. An electrical connector assembly comprising:

a printed circuit board;

an insulative housing mounted on the printed circuit board and defining a card receiving slot and a side chamber;

a daughter board received in the card receiving slot;

a plurality of contacts disposed in the housing and extending in an oblique manner relative to the housing, each of said contacts having one end extending into the card receiving slot to engage the daughter board and the other end extending out of a bottom face of the housing to engage the printed circuit board; and a module inserted into the chamber to protectively hide the contacts from an exterior laterally; wherein both said ends of each of said contacts result in wiping action against the corresponding daughter board and the printed circuit board, respectively, when said daughter board is inserted into the card receiving slot.

16. The assembly as claimed in claim 15, wherein said module is assembled to the housing laterally.

17. The assembly as claimed in claim 15, wherein said module includes a grounding plate.

* * * * *